US008206104B2

(12) United States Patent
Horng et al.

(10) Patent No.: US 8,206,104 B2
(45) Date of Patent: Jun. 26, 2012

(54) FRAME STRUCTURE FOR FAN

(75) Inventors: Alex Horng, Kaohsiung (TW); Jai-Jing Tsai, Kaohsiung (TW)

(73) Assignee: Sunonwealth Electric Machine Industry Co., Ltd., Kaoshiung (TW)

( * ) Notice: Subject to any disclaimer, the term of this patent is extended or adjusted under 35 U.S.C. 154(b) by 1214 days.

(21) Appl. No.: 12/003,530

(22) Filed: Dec. 28, 2007

(65) Prior Publication Data

US 2009/0142190 A1 Jun. 4, 2009

(30) Foreign Application Priority Data

Dec. 4, 2007 (TW) ..... 96146192 A

(51) Int. Cl.
*F04D 29/52* (2006.01)

(52) U.S. Cl. ..... 415/215.1; 415/220

(58) Field of Classification Search ..... 415/200, 415/215.1, 220

See application file for complete search history.

(56) References Cited

U.S. PATENT DOCUMENTS

| | | | | |
|---|---|---|---|---|
| 6,431,910 | B1 * | 8/2002 | Chuang et al. | 439/577 |
| 7,140,837 | B2 * | 11/2006 | Ku et al. | 415/121.2 |
| 7,442,005 | B2 * | 10/2008 | Yeh et al. | 415/200 |
| 7,604,459 | B2 * | 10/2009 | Horng et al. | 415/214.1 |
| 2009/0047148 | A1 * | 2/2009 | Chen et al. | 417/354 |
| 2009/0230798 | A1 * | 9/2009 | Ho | 310/89 |
| 2010/0074746 | A1 * | 3/2010 | Huang | 415/220 |
| 2011/0108251 | A1 * | 5/2011 | Horng | 165/121 |

* cited by examiner

*Primary Examiner* — Nathaniel Wiehe

(74) *Attorney, Agent, or Firm* — Alan Kamrath; Kamrath IP Lawfirm, PA

(57) ABSTRACT

A fan frame structure includes a plastic frame and a metal fixing frame, in which at least two support arms are disposed on the rim of the fixing frame and extended outwardly therefrom, the outwardly extended distance of each support arm shall be beyond the range of an accommodation space of the frame, the portion of the support arm beyond the accommodation space in integrally enclosed by the plastic material of the frame.

16 Claims, 9 Drawing Sheets

FRAME STRUCTURE FOR FAN

FIELD OF THE INVENTION

The present invention relates to fan frame structure, and more particularly to a product capable of reducing costs of materials and molds, for securing good material management and providing a product with a variety of specifications.

BACKGROUND OF THE INVENTION

A fan frame structure is as shown in FIG. 1. Its frame 10 has an accommodation space 11, and there is a bottom base 12 therein. A shaft tube seat 13 is disposed centrally on the bottom base 12 so that a fan motor and fan blades (not shown) can be fixedly mounted on the bottom base 12 and are located in the accommodation space 11. The bottom base 12 and the inner wall of the accommodation space are connected by a plurality of support arms 14 so as to integrally integrate the bottom base 12 and the frame.

As the conventional fan frame is integrally formed by die casting with metal material (i.e. aluminum), the disadvantages arise therefrom are as follows:

High material cost: The cost of metal material is certainly far higher than the cost of plastic material, adding that the prices of metal materials keep skyrocketing in recent years and further keeping the price of the metal fan frame integrally formed by die casting at a high level.

Quality issue: If a fan frame is entirely made of plastic material and the support arms of the bottom base are too flimsy and prone to breakage, the quality issue will be resulted.

High cost of mold: For sake of meeting various environment requirements for heat dissipation, cooling fan may need to replace fan motor with different power while not changing the size of the frame. As a result, many specifications actually provide a common frame size, and the only difference is the size of the bottom base. However, the conventional frame is integrally formed by die casting. Building a new mold for just size change of the bottom base becomes inevitable and is not cost-effective.

Difficult material management: In response to the assembling requirement of fan motors with assorted powers, the specifications and types of fan frames become more and more complicated, the stocked materials and parts are plentiful, and large warehousing space is demanded, all causing the difficulty of warehousing management.

SUMMARY OF THE INVENTION

In view of the foregoing concern, the present invention thus provides a fan frame structure, including: a frame made of plastic material and having an accommodation space with a range being greater than the maximum outer diameter of fan blades, a fixing frame made of metal material and having a bottom base for mounting a fan motor, in which at least two support arms extended outwardly are formed on the rim of the bottom base, and the distance of the support arm that is extended outwardly shall be beyond the range of the accommodation space.

While forming the fan frame of the present invention by injection molding, the portions of the support arms of the fixing frame extended beyond the accommodation space are integrally integrated with the fan frame by injection molding, such that the support arms are integrally enclosed by the plastic material of the fan frame to form a fan frame structure.

Therefore, the present invention not only significantly lowers material cost, but also produces a variety of products with a single injection mold for the frame in accordance with various specifications of the fixing frame. On the one hand, the mold cost can be saved, and on the other hand, the warehousing management can be simplified and the quality issue of cracked support arm can be prevented.

DETAILED DESCRIPTION OF THE PREFERRED EMBODIMENT

Figure 1:
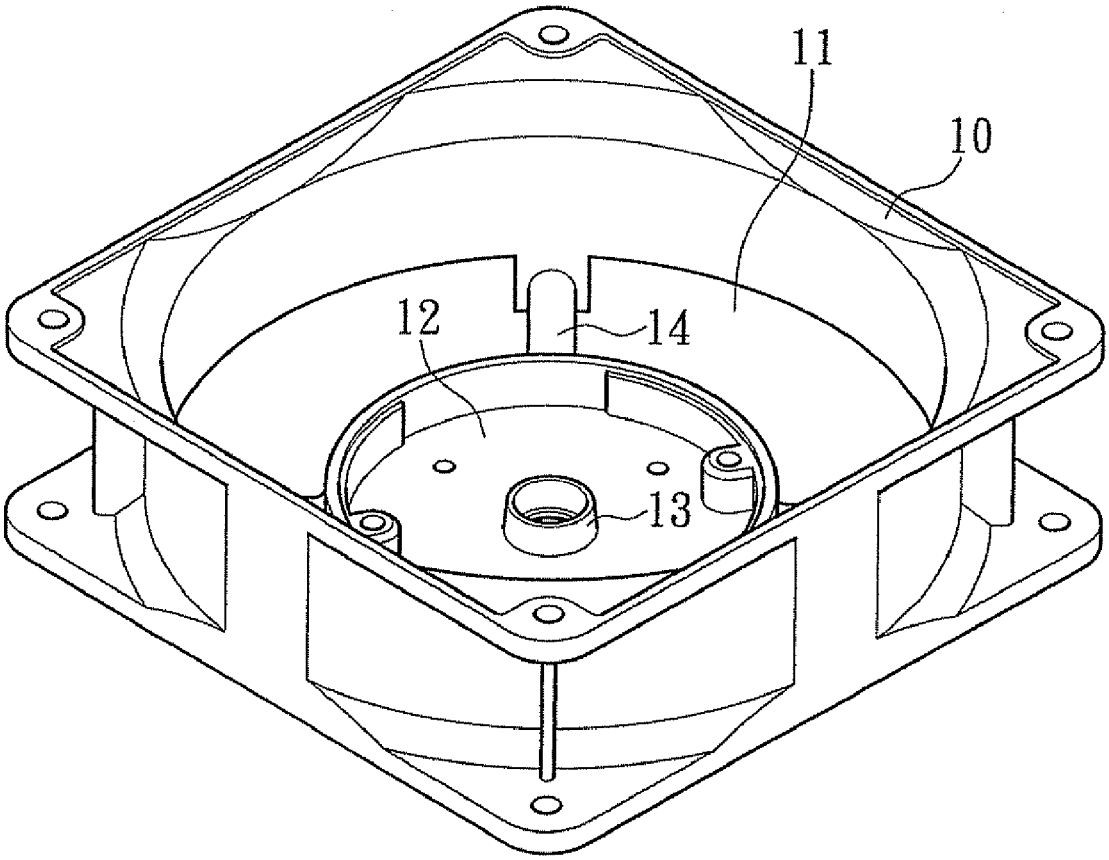
Fig. 1 (PRIOR ART)
FIG. 1 is an external three-dimensional view showing a conventional structure.
Figure 2:
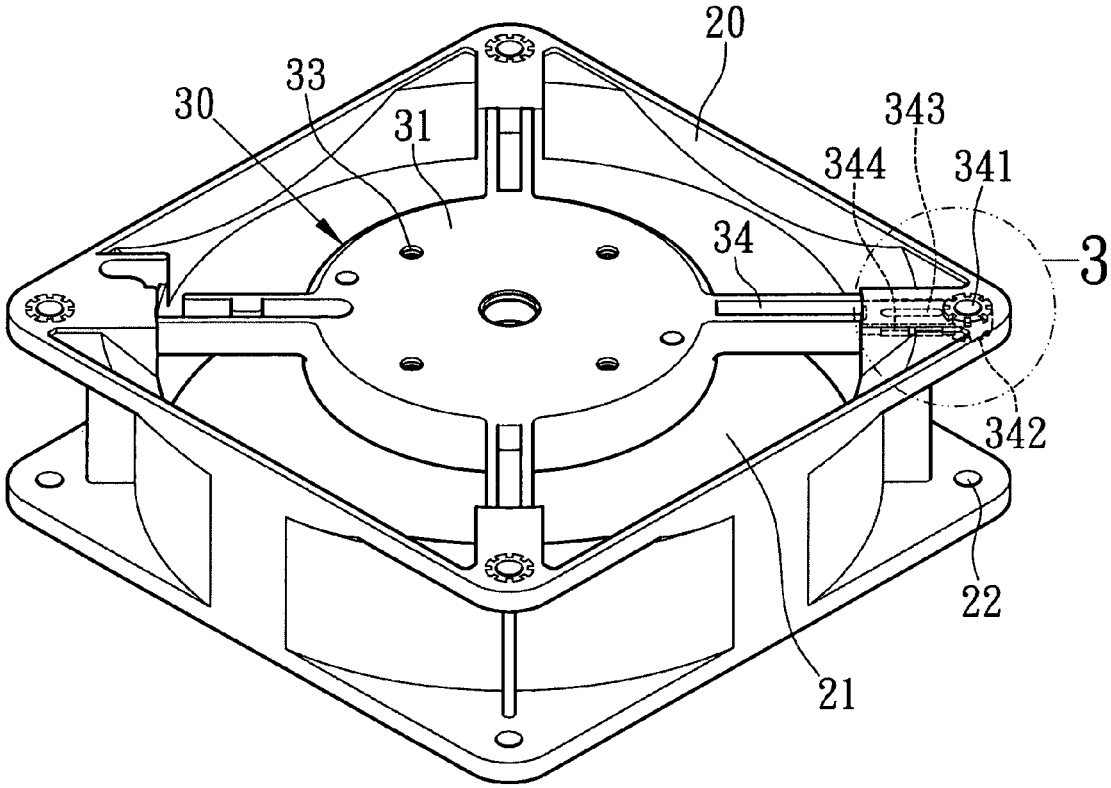
FIG. 2 is an external three-dimensional view of the present invention.
Figure 3:
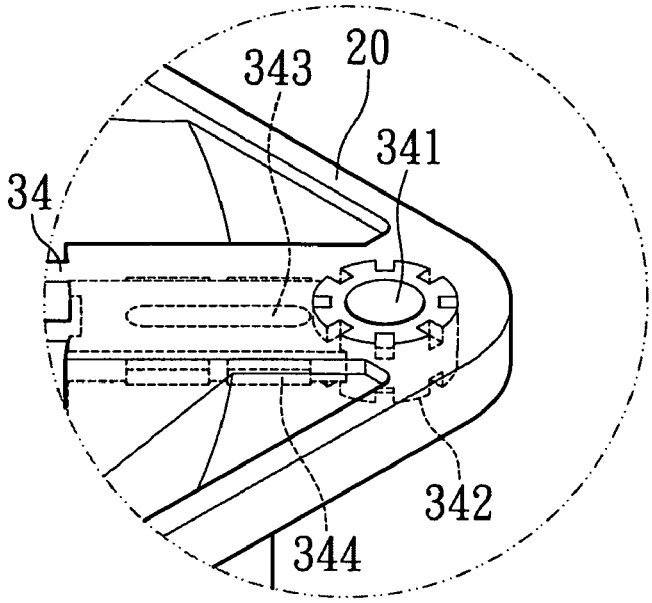
FIG. 3 is a partially enlarged schematic view of FIG. 2.
Figure 4:
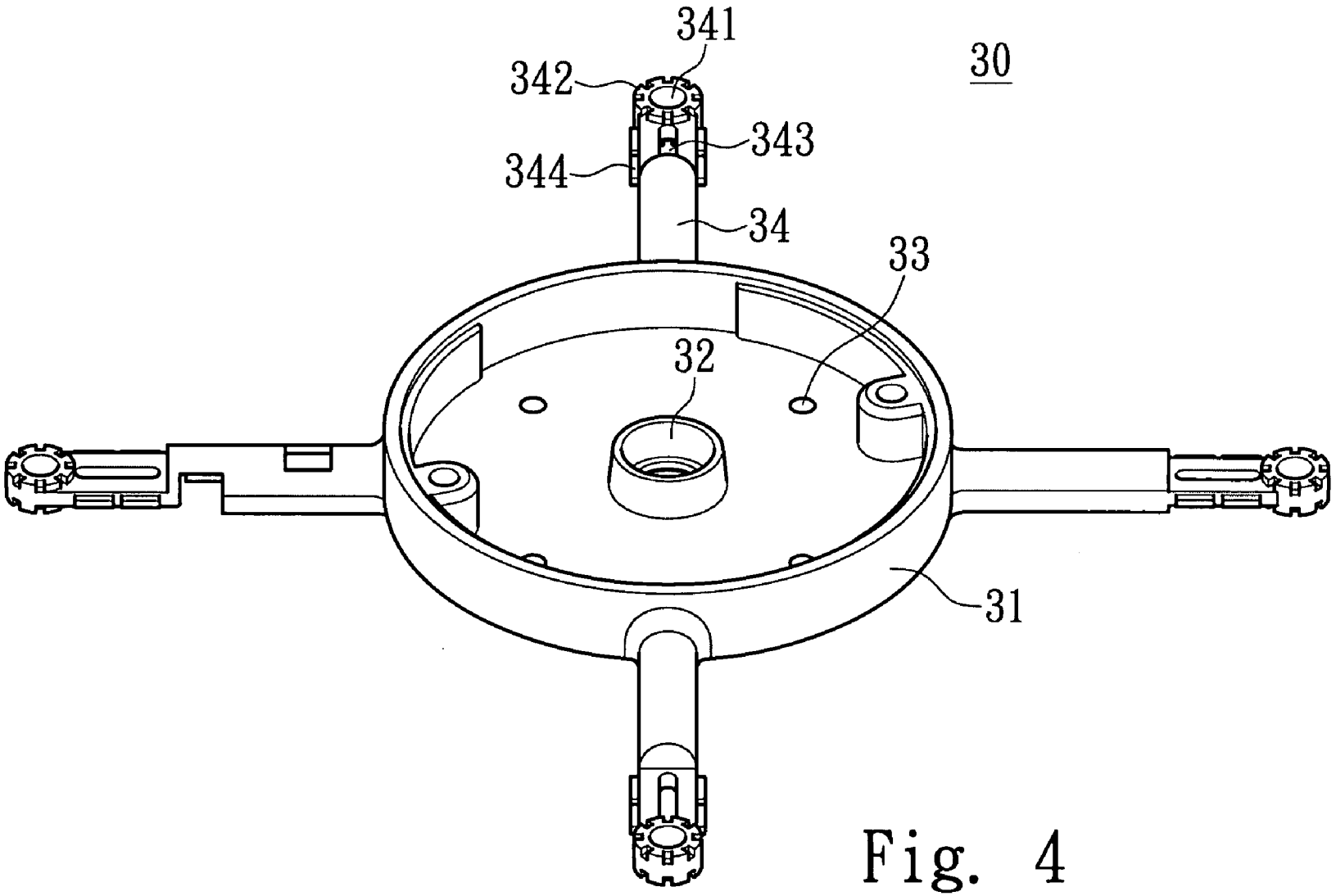
FIG. 4 is an external three-dimensional view of the fixing frame in the present invention.

To stand out and comprehend the aforementioned objective, features and advantages of the present invention more, preferred embodiments of the present invention are specifically presented as follows along with detailed illustrative description:

Please refer to FIG. 2 and FIG. 3, which are an external three-dimensional view of the present invention and a partially enlarged schematic view of FIG. 2 respectively and include:

a frame 20 made of plastic material and having an accommodation space 21 therein, in which the range of the accommodation space 21 is greater than the maximal outer diameter of fan blades (not shown), and a plurality of holes 22 are disposed on the frame 20 for the frame 20 to be fixed at a predetermined position of a cooling environment;

a fixing frame 30 made of metal material (i.e. aluminum), together with the illustration of FIG. 4, and having a bottom base 31, in which a shaft tube seat 32 and at least a feed hole 33 are disposed on the bottom base 31 for a fan motor and blades (not shown) to be mounted and fixed on the bottom base 31, at least two support arms 34 (four in FIG. 4) disposed on the rim of the bottom base 31 and extended outwardly therefrom, the outwardly extended distance of those support arms 34 shall be beyond the range of the accommodation space 21, an outer end of each support arm 34 has an assembling hole 341, wheel-like sectional trenches 342 are formed on the outer periphery of the assembling hole in an irregular fashion, a slotted hole 343 and flanges 344 are additionally disposed on an inner segment in relative to the outer end, and the assembling hole 341, the wheel-like sectional trenches 342, the slotted hole 343 and flanges 344 shall be located on a portion of the support arm 34 beyond the range of the accommodation space 21.

In cooperation with the illustration of FIG. 2 and FIG. 3, while forming the frame 20 by an injection mold, the fixing frame 30 and the frame 20 are integrally formed as a fan frame structure by injection molding.

Figure 6:
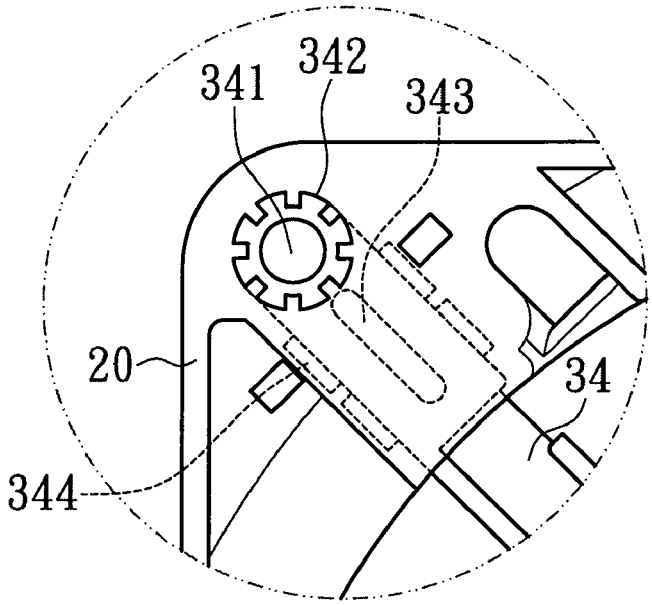
FIG. 6 is a partially enlarged schematic view of FIG. 5.
Figure 5:
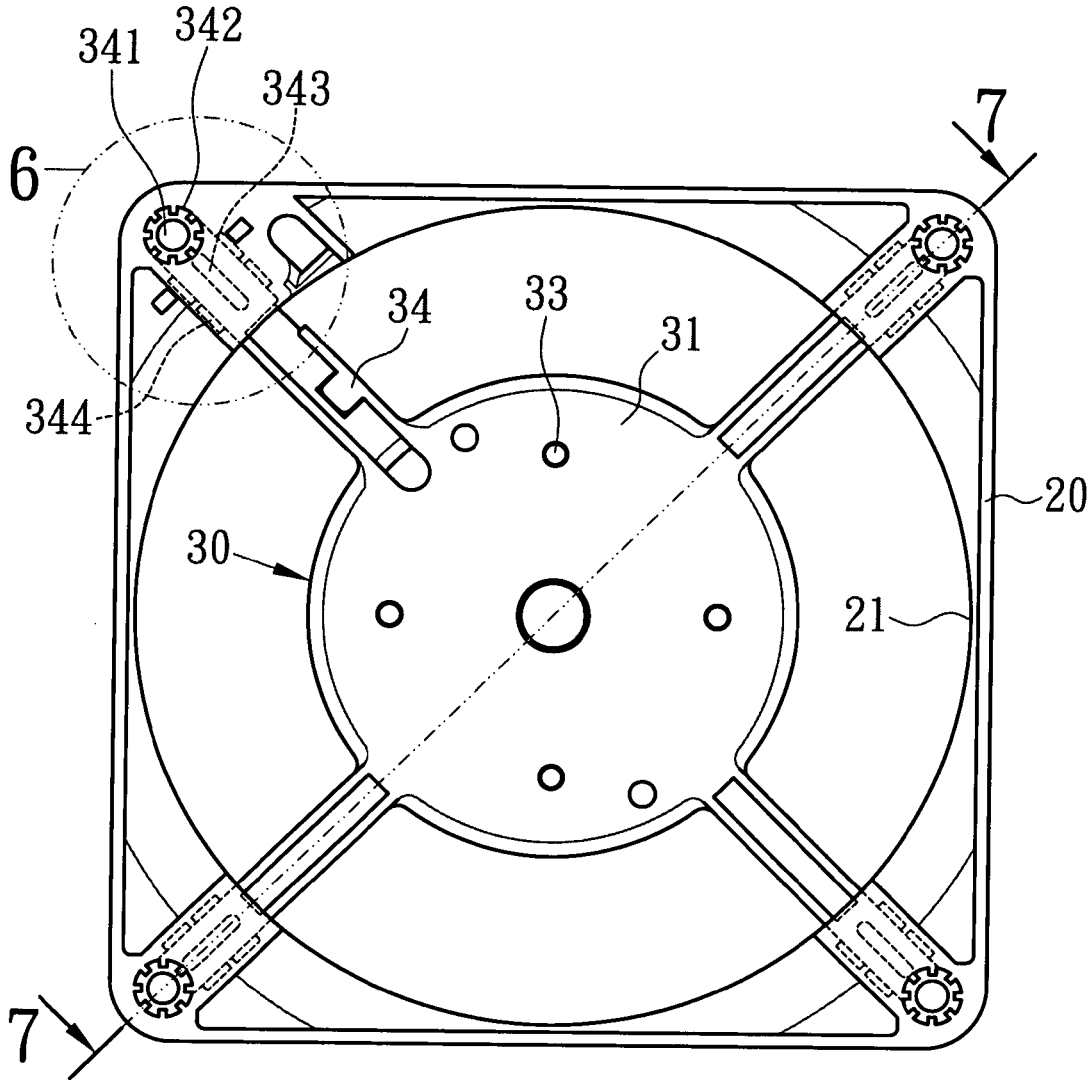
FIG. 5 is a bottom view of the present invention.

The fixing frame 30 is placed in a predetermined position inside the cavity of the injection mold for the frame 20 in advance so that the portion of each support arm 34 of the fixing frame 30 beyond the range of the accommodation space 21 is enclosed by and integrated with the frame 20 (as shown in FIG. 5 and FIG. 6) to form a fan frame structure for assembling the fan motor and the fan blades when plastic material is poured in the cavity to mold the frame 20.

Figure 7:
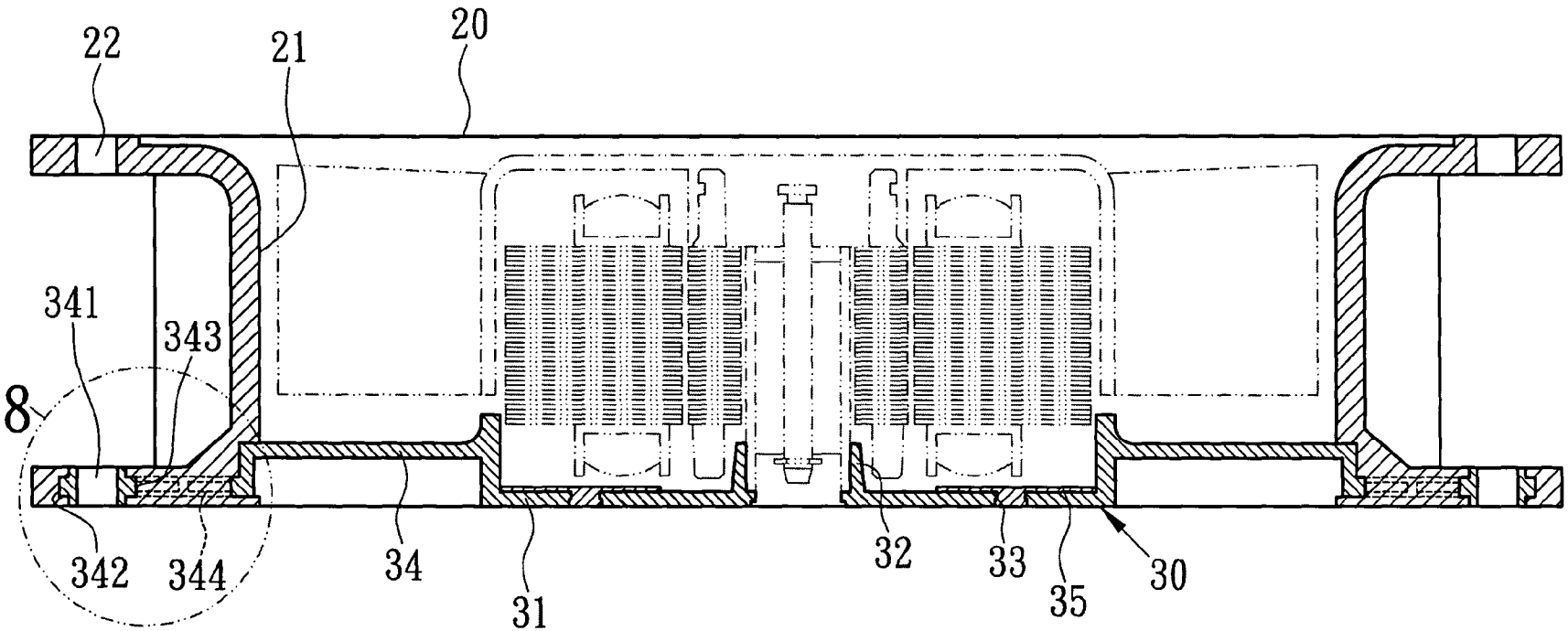
FIG. 7 is a cross-sectional view of the present invention.
Figure 8:
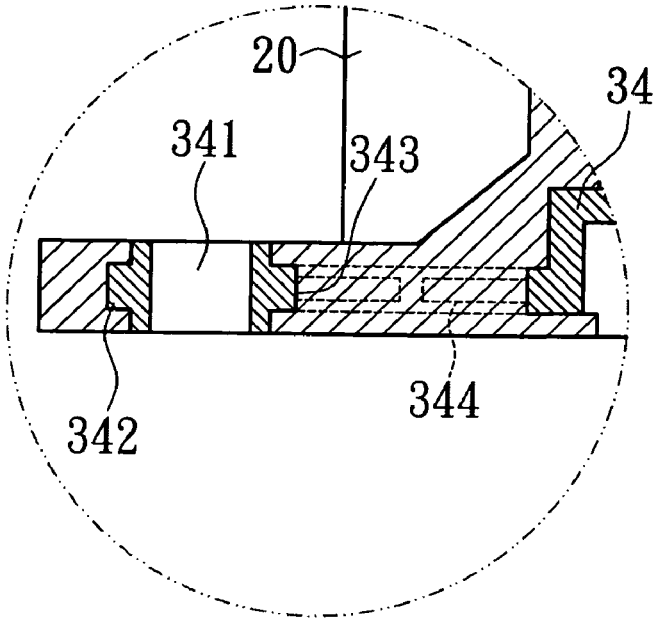
FIG. 8 is a partially enlarged schematic view of FIG. 7.

Furthermore, in cooperation with the illustration of FIG. 7 and FIG. 8, the openings over both ends of the assembling hole 341 of each support arm 34 shall not be covered by the plastic material of the frame 20 and correspond to holes 22 of the frame 20. As the portions of the support arm 34 covered by the plastic material of the frame 20 all have the wheel-like sectional trenches 342, the slotted hole 343 and the flanges 344, the plastic material of the frame 20 can tightly enclose each support arm 34 and the frame won't come loose or exfoliate accordingly.

Figure 9:
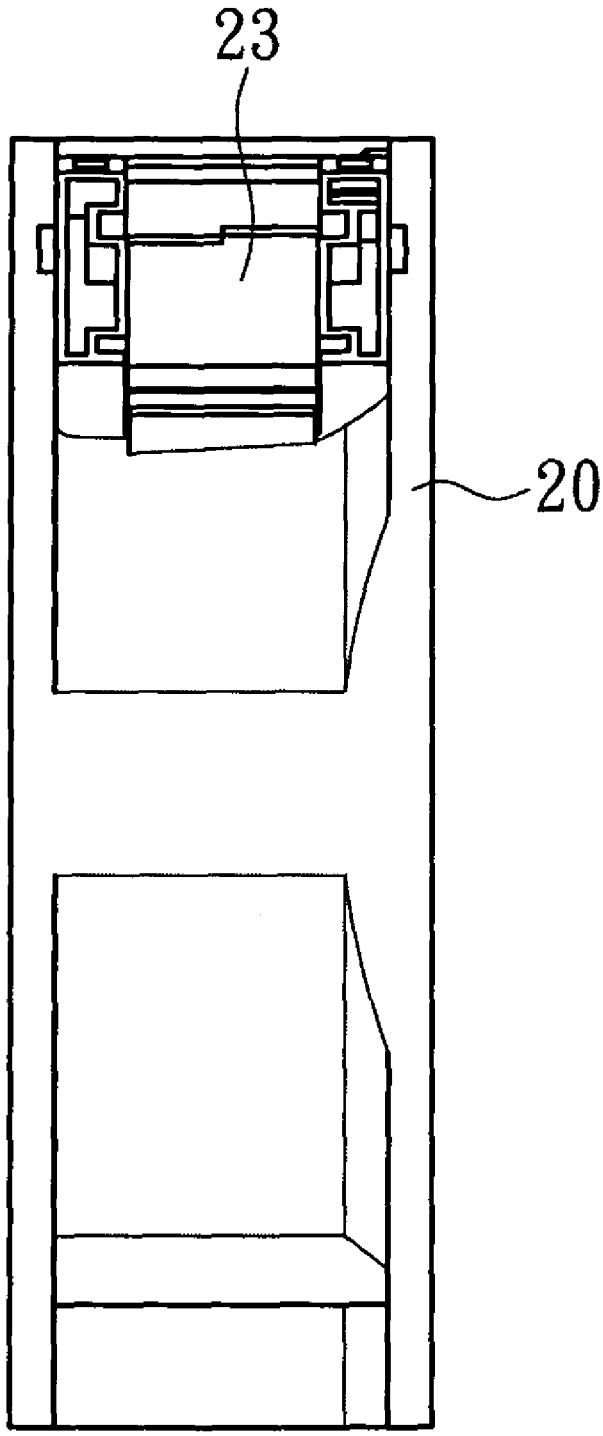
FIG. 9 is a side view of the present invention.

In cooperation with the illustration of FIG. 9, a power cord socket 23 is disposed on one side of the molded frame 20 for a power cord to be plugged in to supply power required for the fan operation.

Figure 11:
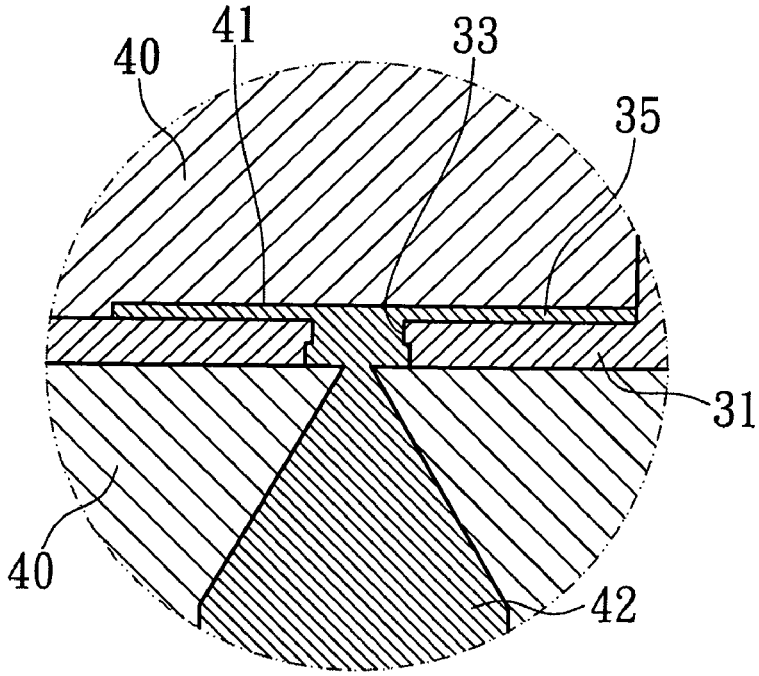
FIG. 11 is a partially enlarged schematic view of FIG. 10.
Figure 10:
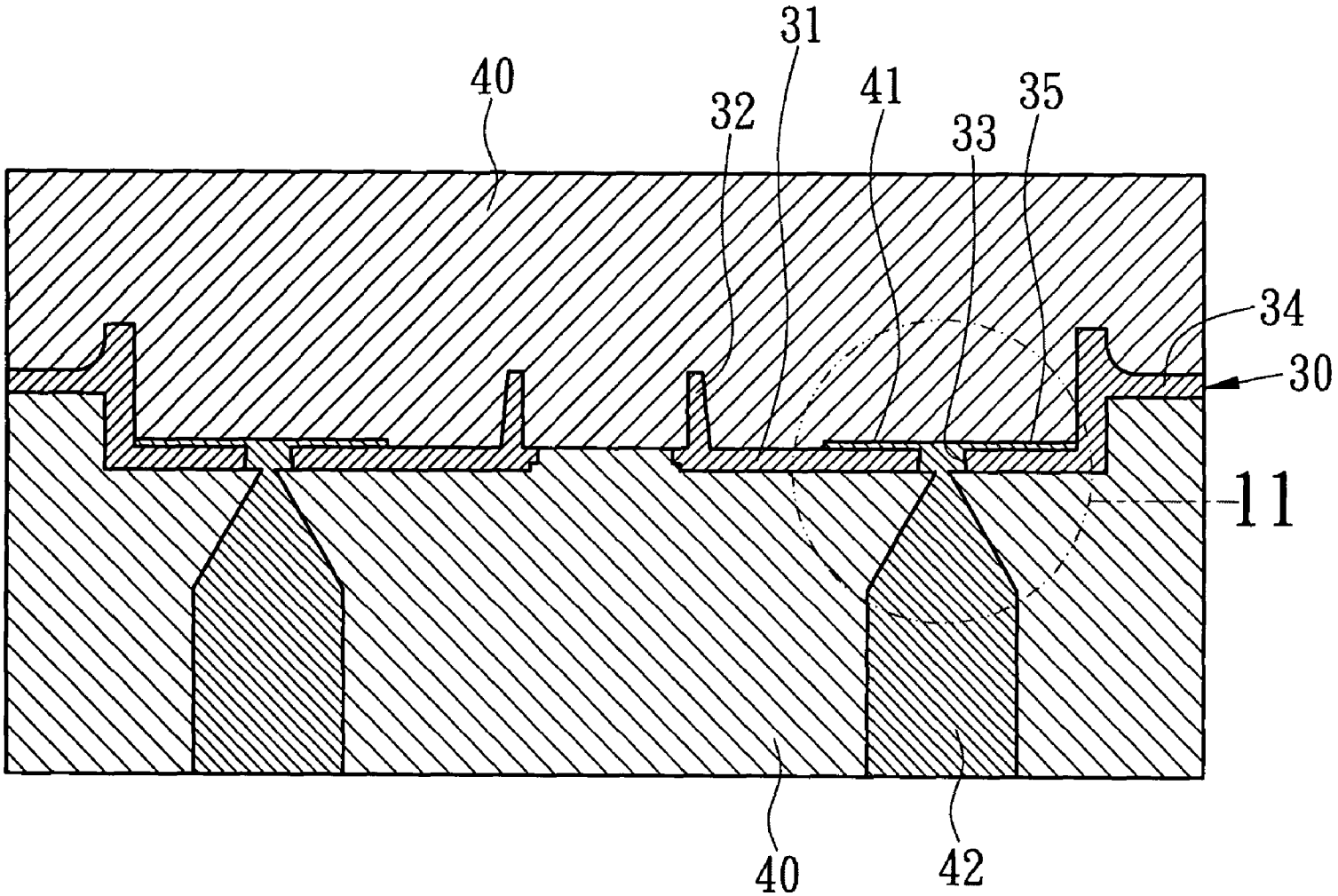
FIG. 10 is a molding schematic view showing the insulating plate of the present invention.

Please refer to FIG. 10 and FIG. 11. The frame 20 of the present invention is molded by an injection mold. While the end portions of the support arms 34 of the fixing frame 30 are integrally integrated, an insulating plate 35 can be injection-molded to surround the shaft tube seat 32 of the bottom base 31 and can be placed between the motor stator and the metallic bottom base 31 for insulation.

After placing the fixing frame 30 into a predetermined position inside the cavity of an injection mold for the frame, the mold 40 has a reserved space 41 disposed therein to correspond to a predetermined molding position of the insulating plate 35. An injection opening 42 is additionally disposed at a feed hole 33 of the bottom base 31 so as to simultaneously injection-mold the insulating plate 35 while injection-molding the frame 20. The feed hole 33 can be designed as a stepwise hole with different hole diameters, the holes with the smaller hole diameters are located at one side thereof near the insulating plate 35, and the holes with larger hole diameters is located at the other side near the injection opening 42. Consequently, after mold release, the insulating plate 35 is firmly integrated on the portion of the bottom base 31 and around the shaft tube seat 32 by the filled plastic material through the stepwise hole and won't come off.

In contrast to conventional structure, the present invention has the following advantages:

(1) cost reduction: The present invention employs the plastic material with lower price to produce the frame but still employs metal material to produce the fixing frame. As the assembling holes of the support arms of the fixing frame correspond to the holes of the frame and the frame can be fixed at a predetermined position of a cooling environment, not only can the material cost be significantly lowered, but also the stability of fan motor operation can still be maintained.

(2) Low mold cost: The present invention not only replaces a fixing frame matching with a fan motor with different power, but also generates fan frame structures with various specifications by using a single injection mold for the frame without opening mold again or changing mold design at all.

(3) Easy management: The present invention coordinates with the fixing frames with various specifications to generate a variety of products with a single injection mold for the frame, greatly simplifying the warehousing management conditions, such as the stock classification, stocking space and so forth.

(4) Versatility: The present invention coordinates with the fixing frames with various specifications to generate a variety of products with a single injection mold for the frame. Instead, the conventional structure employs the same frame for fan motors with different powers for sake of avoiding the mold cost for building new mold again, and it turns out to be that the smoothness and cooling efficacy of the overall flow field is affected.

(5) No quality issue: The present invention avoids the quality issue that the support arm is prone to fracture while molding the entire frame with plastic material.

In sum, from the above-mentioned characteristics those features not only have a novelty among similar products and a progressiveness but also have an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A fan frame structure, comprising:

a frame made of plastic material and having an accommodation space with a range greater than a maximal outer diameter of fan blades;

a fixing frame made of metal material and having a bottom base for mounting a fan motor and at least two support arms disposed on a rim of said bottom base and extended outwardly therefrom;

wherein an outwardly extended distance of said support arm is beyond said range of said accommodation space, and a portion of each said support arm beyond said range of said accommodation space is integrally enclosed by a plastic material of said frame to form said fan frame structure, and wherein an end of each said support arm beyond said accommodation space has an assembling hole, and both ends of said assembling hole are not enclosed by said plastic material of said frame.

2. The fan frame structure as set forth in claim 1, wherein a plurality of holes are disposed on said frame and correspond to said plural assembling holes for said fan frame structure to be fixed at a predetermined position of a cooling environment.

3. The fan frame structure as set forth in claim 1, wherein an end of each said support arm beyond said accommodation space has wheel-like sectional trenches, a slotted hole and flanges in an irregular fashion.

4. The fan frame structure as set forth in claim 1, wherein a power cord socket is disposed on one side of said frame for a power cord to be plugged in and connected so as to supply power to said frame.

5. The fan frame structure as set forth in claim 1, wherein a shaft tube seat and at least one feed hole are disposed on said bottom base, an insulating plate is disposed on a portion around said shaft tube seat and between said fan motor and said bottom base for insulation, a reserved space of a cavity of an injection mold for said frame is provided to correspond to a predetermined position of said insulating plate, an injection opening is provided at a place corresponding to a feed hole, so as to enable simultaneous injection molding of said insulating plate and said frame.

6. The fan frame structure as set forth in claim 5, wherein said feed hole pertains to a stepwise hole with different hole diameters, holes of said stepwise hole with smaller hole diameters are located at one side near said insulating plate, and holes of said stepwise hole with larger hole diameters are located at the other side near said injection opening.

7. A fan frame structure, comprising:

a frame made of plastic material and having an accommodation space with a range greater than a maximal outer diameter of fan blades and a plurality of holes thereon;

a fixing frame made of metal material and having a bottom base for mounting a fan motor and at least two support arms disposed on a rim of said bottom base and extended outwardly therefrom;

wherein an outwardly extended distance of said support arm is beyond said range of said accommodation space, and a portion of each said support arm beyond said range of said accommodation space has an assembling hole and is integrally enclosed by a plastic material of said frame to correspond to said hole of said frame for fixing said frame at a predetermined position of a cooling environment, and wherein an end of each said support arm beyond said accommodation space has wheel-like sectional trenches, a slotted hole and flanges in an irregular fashion.

8. The fan frame structure as set forth in claim 7, wherein a power cord socket is disposed on one side of said frame for a power cord to be plugged in and connected so as to supply power to said frame.

9. The fan frame structure as set forth in claim 7, wherein a shaft tube seat and at least one feed hole are disposed on said bottom base, an insulating plate is disposed on a portion around said shaft tube seat and between said fan motor and said bottom base for insulation, a reserved space of a cavity of an injection mold for said frame is provided to correspond to a predetermined position of said insulating plate, an injection opening is provided at a place corresponding to a feed hole, so as to enable simultaneous injection molding of said insulating plate and said frame.

10. The fan frame structure as set forth in claim 9, wherein said feed hole pertains to a stepwise hole with different hole diameters, holes of said stepwise hole with smaller hole diameters are located at one side near said insulating plate, and holes of said stepwise hole with larger hole diameters are located at the other side near said injection opening.

11. A fan frame structure, comprising:

a frame made of plastic material and having an accommodation space with a range greater than a maximal outer diameter of fan blades;

a fixing frame made of metal material and having a bottom base for mounting a fan motor, a shaft tube seat and at least a feed hole disposed on said bottom base, an insulating plate is disposed on a portion around said shaft tube seat and between said fan motor and said bottom base for insulation, and at least two support arms disposed on a rim of said bottom base and extended outwardly therefrom;

wherein an outwardly extended distance of said support arm is beyond said range of said accommodation space, a portion of each said support arm beyond said range of said accommodation space is integrally enclosed by a plastic material of said frame to form a fan frame structure, a reserved space of a cavity of an injection mold for said frame is provided to correspond to a predetermined position of said insulating plate, an injection opening is provided at a place corresponding to a feed hole, so as to enable simultaneous injection molding of said insulating plate and said frame.

12. The fan frame structure as set forth in claim 11, wherein said feed hole pertains to a stepwise hole with different hole diameters, holes of said stepwise hole with smaller hole diameters are located at one side near said insulating plate, and holes of said stepwise hole with larger hole diameters are located at the other side near said injection opening.

13. The fan frame structure as set forth in claim 11, wherein an end of each said support arm beyond said accommodation space has an assembling hole, and both ends of said assembling hole are not enclosed by said plastic material of said frame.

14. The fan frame structure as set forth in claim 11, wherein said frame has a plurality of holes thereon corresponding to assembling holes for fixing said frame on a predetermined position of a cooling environment.

15. The fan frame structure as set forth in claim 11, wherein an end of each said support arm beyond said accommodation space has wheel-like sectional trenches, a slotted hole and flanges in an irregular fashion.

16. The fan frame structure as set forth in claim 11, wherein a power cord socket is disposed on one side of said frame for a power cord to be plugged in and connected so as to supply power to said frame.

* * * * *